US008262190B2

(12) United States Patent
Mizes et al.

(10) Patent No.: US 8,262,190 B2
(45) Date of Patent: Sep. 11, 2012

(54) METHOD AND SYSTEM FOR MEASURING AND COMPENSATING FOR PROCESS DIRECTION ARTIFACTS IN AN OPTICAL IMAGING SYSTEM IN AN INKJET PRINTER

(75) Inventors: Howard A. Mizes, Pittsford, NY (US); Helen HaeKyung Shin, Fairport, NY (US); Yeqing Zhang, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 329 days.

(21) Appl. No.: 12/780,654

(22) Filed: May 14, 2010

(65) Prior Publication Data

US 2011/0279503 A1 Nov. 17, 2011

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | |
|---|---|---|---|
| 4,328,504 | A | 5/1982 | Weber et al. |
| 4,509,057 | A | 4/1985 | Sohl et al. |
| 5,075,689 | A | 12/1991 | Hoisington et al. |
| 5,160,938 | A | 11/1992 | Fargo et al. |
| 5,212,497 | A | 5/1993 | Stanley et al. |
| 5,477,244 | A | 12/1995 | Shibata et al. |
| 5,576,744 | A | 11/1996 | Niikura et al. |
| 5,726,690 | A | 3/1998 | Bohorquez et al. |
| 5,831,658 | A | 11/1998 | Iga et al. |
| 5,835,108 | A | 11/1998 | Beauchamp et al. |
| 5,847,724 | A | 12/1998 | Mantell |
| 5,903,681 | A | 5/1999 | Rueby et al. |
| 5,923,344 | A | 7/1999 | Norum et al. |
| 5,992,962 | A | 11/1999 | Yen et al. |
| 6,102,513 | A | 8/2000 | Wen |
| 6,141,114 | A | 10/2000 | Mantell et al. |
| 6,145,959 | A | 11/2000 | Lund et al. |
| 6,168,261 | B1 | 1/2001 | Miyake et al. |
| 6,206,502 | B1 | 3/2001 | Kato et al. |
| 6,247,787 | B1 | 6/2001 | Giere et al. |
| 6,273,542 | B1 | 8/2001 | Couwenhoven et al. |
| 6,315,383 | B1 | 11/2001 | Sarmast et al. |
| 6,367,903 | B1 | 4/2002 | Gast et al. |
| 6,390,580 | B1 | 5/2002 | Anderson et al. |
| 6,464,334 | B2 | 10/2002 | Lopez et al. |
| 6,532,026 | B2 | 3/2003 | Takahashi et al. |
| 6,568,786 | B2 | 5/2003 | Sarmast et al. |
| 6,590,598 | B2 | 7/2003 | Kodama |
| 6,764,156 | B2 | 7/2004 | Mantell |
| 6,814,425 | B2 | 11/2004 | Mott et al. |
| 6,819,352 | B2 | 11/2004 | Mizes et al. |
| 7,090,324 | B2 | 8/2006 | Mizes |

(Continued)

*Primary Examiner* — Lamson Nguyen
(74) *Attorney, Agent, or Firm* — Maginot, Moore & Beck, LLP

(57) ABSTRACT

A printer operating method enables a controller to identify process direction errors in an optical imaging system. The method includes identifying a printhead roll error for each printhead in a plurality of printheads in a printer, moving each printhead by an amount that corrects the printhead roll error for the corresponding printhead, generating a plurality of dashes on media with the plurality of printheads as the media moves past the plurality of printheads, identifying a position for each dash in the process direction from image data of the plurality of dashes on the media, identifying a displacement in the process direction for each optical detector in a linear array of optical detectors used to generated the image data of the plurality of dashes, the displacement being identified with reference to the identified positions for the dashes, and operating the printer to compensate for the identified displacements of the optical detectors.

18 Claims, 8 Drawing Sheets

U.S. PATENT DOCUMENTS

| | | | |
|---|---|---|---|
| 7,314,261 | B2 | 1/2008 | Jackson Pulver et al. |
| 7,347,525 | B2 | 3/2008 | Mizes |
| 7,367,642 | B2 | 5/2008 | Ouchi et al. |
| 7,515,305 | B2 | 4/2009 | Mizes |
| 7,524,007 | B2 | 4/2009 | Pulver et al. |
| 7,524,015 | B2 | 4/2009 | Srinivasan et al. |
| 7,543,911 | B2 | 6/2009 | Mizes et al. |
| 7,597,418 | B2 | 10/2009 | Mantell et al. |
| 2009/0003729 | A1 | 1/2009 | Metcalfe et al. |

METHOD AND SYSTEM FOR MEASURING AND COMPENSATING FOR PROCESS DIRECTION ARTIFACTS IN AN OPTICAL IMAGING SYSTEM IN AN INKJET PRINTER

TECHNICAL FIELD

This disclosure relates generally to printhead alignment in an inkjet printer having one or more printheads, and, more particularly, to an optical imaging system used to generate image data of test patterns used to align the printheads in an inkjet printer.

BACKGROUND

Ink jet printers have printheads that operate a plurality of inkjets that eject liquid ink onto an image receiving member. The ink may be stored in reservoirs located within cartridges installed in the printer. Such ink may be aqueous ink or an ink emulsion. Other inkjet printers receive ink in a solid form and then melt the solid ink to generate liquid ink for ejection onto the imaging member. In these solid ink printers, the solid ink may be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

In order for the printed images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern and then the printed image of the ejected ink is analyzed to determine the orientation of the printhead with reference to the imaging surface and with reference to the other printheads in the printer. Operating the printheads in a printer to eject ink in correspondence with image data presumes that the printheads are level with a width across the image receiving member and that all of the inkjet ejectors in the printhead are operational. The presumptions regarding the orientations of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer. In some printing systems, an image of a printed image is generated by printing the printed image onto media or by transferring the printed image onto media, ejecting the media from the system, and then scanning the image with a flatbed scanner or other known offline imaging device. This method of generating a picture of the printed image suffers from the inability to analyze the printed image in situ and from the inaccuracies imposed by the external scanner. In some printers, a scanner is integrated into the printer and positioned at a location in the printer that enables an image of an ink image to be generated while the image is on media within the printer or while the ink image is on the rotating image member. These integrated scanners typically include one or more illumination sources and a plurality of optical detectors that receive radiation from the illumination source that has been reflected from the image receiving surface. The radiation from the illumination source is usually visible light, but the radiation may be at or beyond either end of the visible light spectrum. If light is reflected by a white surface, the reflected light has the same spectrum as the illuminating light. In some systems, ink on the imaging surface may absorb a portion of the incident light, which causes the reflected light to have a different spectrum. In addition, some inks may emit radiation in a different wavelength than the illuminating radiation, such as when an ink fluoresces in response to a stimulating radiation. Each optical sensor generates an electrical signal that corresponds to the intensity of the reflected light received by the detector. The electrical signals from the optical detectors may be converted to digital signals by analog/digital converters and provided as digital image data to an image processor.

One known optical imaging system is configured to detect, for example, the presence, intensity, and/or location of ink drops jetted onto the receiving member by the inkjets of the printhead assembly. The light source for the imaging system may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to a controller or some other control circuitry to activate the LEDs for image illumination.

The reflected light is measured by the light detector in the optical imaging system. The light sensor, in one embodiment, is a linear array of photosensitive devices, such as charge coupled devices (CODs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member.

Arranging the optical sensors on a linear array may produce inaccuracies in the image data generated by the optical imaging system. As shown in FIG. 8(*a*), image data are generated for a test pattern of dashes on an image member with a straight and properly positioned linear array. In FIG. 8(*b*), image data of a test pattern of dashes are generated by a linear array that is slanted across the face of the media being imaged. As a result, the image data indicate the printheads ejecting the ink drops onto the media are at different positions in the process direction, when, in fact, the printheads may be at the same position in the process direction. Another inaccuracy may arise if the linear array is not truly straight. If the member to which the optical detectors are mounted is bowed, then the image data again depicts the ink drops ejected by printheads in the area of a bow as not being aligned with other printheads in the process direction. An example of the image data generated by a bowed linear array is shown in FIG. 8(*c*). Another issue that may arise with the linear array of optical detectors is the orientation of the lenses that directed reflected light onto the optical detectors. If these lenses do not have their axes aligned with one another, waviness may appear in the image data as shown in FIG. 8(*d*). Detecting and compensating for these inaccuracies in image data produced by a linear array of optical detectors would be useful.

SUMMARY

A method of operating a printer enables skew, bow, and lens artifacts in image data to be detected and compensation techniques enabled. The method includes identifying a printhead roll error for each printhead in a plurality of printheads in a printer, moving each printhead by an amount that corrects the printhead roll error for the corresponding printhead, generating a plurality of dashes on media with the plurality of printheads as the media moves past the plurality of printheads, identifying a position for each dash in the process direction from image data of the plurality of dashes on the media, identifying a displacement in the process direction for each optical detector in a linear array of optical detectors used to generated the image data of the plurality of dashes, the displacement being identified with reference to the identified positions for the dashes, and operating the printer to compensate for the identified displacements of the optical detectors.

A printer is configured to use the method to detect and compensate for skew, bow, and/or lens artifacts in image data generated by optical detectors mounted in a linear array in the printer. The printer includes a media transport that is configured to transport media through the printer in a process direction, a plurality of print bars, each print bar having a plurality of printheads mounted to each print bar and each printhead being configured to eject ink onto media being transported past the plurality of print bars by the media transport, an imaging device mounted proximate to a portion of the media transport to generate image data corresponding to a cross-process portion of the media being transported through the printer in the process direction after the media has received ink ejected from the printheads, and a controller operatively connected to the imaging device and the plurality of printheads, the controller being configured to operate the printheads to eject ink onto media to form a first plurality of dashes as the media is being transported past the printheads on the bars, to receive image data of the first plurality of dashes on the media generated by the imaging device, to process the image data to identify a displacement distance for each optical detector in the imaging system with reference to an identified position for each dash in the image data of the first plurality of dashes, and to compensate for the identified process direction displacements in operation of the printer.

BRIEF DESCRIPTION OF THE DRAWINGS

The foregoing aspects and other features of a printer that detects and compensates for skew, bow, and/or lens artifacts in image data generated by optical detectors mounted in a linear array in the printer are explained in the following description, taken in connection with the accompanying drawings.

FIG. 8(*b*) is an illustration of image data generated by a skewed linear array of optical detectors.

FIG. 8(*c*) is an illustration of image data generated by a bowed linear array of optical detectors.

FIG. 8(*d*) is an illustration of image data generated by a linear array of optical detectors with lenslet errors.

DETAILED DESCRIPTION

Figure 6:
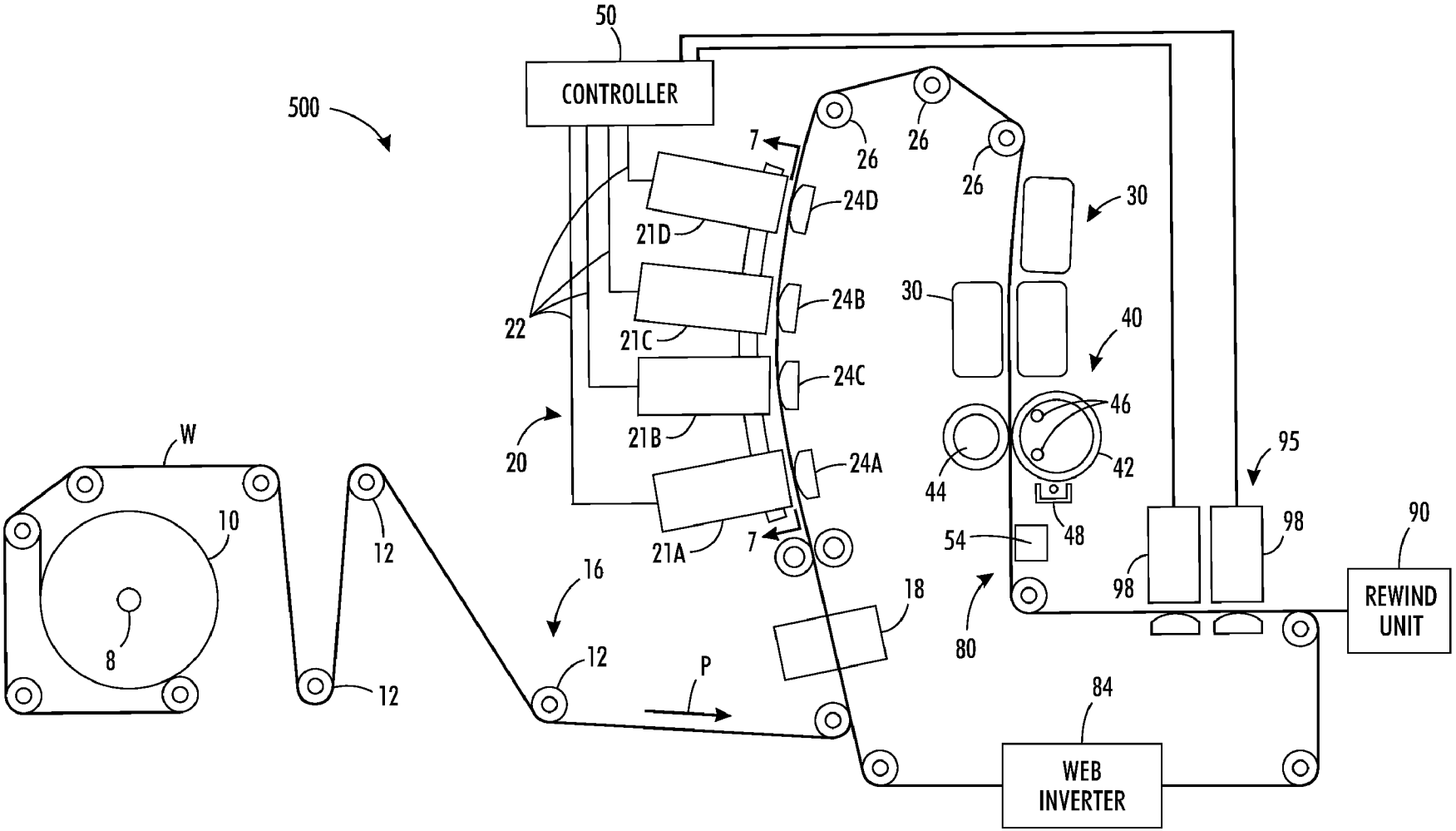
FIG. 6 is a schematic view of an improved inkjet imaging system that ejects ink onto a continuous web of media as the media moves past the printheads in the system.

Referring to FIG. 6, an inkjet imaging system 5 is shown that has been configured to enable electrical motors used to align printheads to be calibrated with reference to the sensitivity and backlash of the motors. For the purposes of this disclosure, the imaging apparatus is in the form of an inkjet printer that employs one or more inkjet printheads and an associated solid ink supply. However, the motor calibration methods described herein are applicable to any of a variety of other imaging apparatuses that use electromechanical motors or other actuators to align the positions of printheads in the system.

The imaging system includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

Direct-to-sheet, continuous-media, phase-change inkjet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color units or modules 21A, 21B, 21C, and 21D, each color module effectively extends across the width of the media and is able to eject ink directly (i.e., without use of an intermediate or offset member) onto the moving media. The arrangement of printheads in the print zone of system 5 is discussed in more detail with reference to FIG. 7. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate timing signals for actuating the inkjet ejectors in the printheads to enable the printheads to eject four colors of ink with appropriate timing and accuracy for registration of the differently color patterns to form color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a color unit or module for each primary color may include one or more printheads; multiple printheads in an module may be formed into a single row or multiple row array; printheads of a multiple row array may be staggered; a printhead may print more than one color; or the printheads or portions thereof can be mounted movably in a direction transverse to the process direction P, also known as the cross-process direction, such as for spot-color applications and the like.

Each of the color modules 21A-21D includes at least one electrical motor configured to adjust the printheads in each of the color modules in the cross-process direction across the media web. In a typical embodiment, each motor is an electromechanical device such as a stepper motor or the like. One embodiment illustrating a configuration of print bars, printheads, and actuators is discussed below with reference to FIG. 4. In a practical embodiment, a print bar actuator is connected to a print bar containing two or more printheads. The print bar actuator is configured to reposition the print bar by sliding the print bar in the cross-process direction across the media web. Printhead actuators may also be connected to individual printheads within each of the color modules 21A-21D. These printhead actuators are configured to reposition an individual printhead by sliding the printhead in the cross-process direction across the media web.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the printing station 20. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing station 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 6, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the electrical motor calibration function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the print bar and printhead motors of the color modules 21A-21D in order to adjust the positions of the printhead bars and printheads in the cross-process direction across the media web. Controller 50 is further configured to determine sensitivity and backlash calibration parameters that are measured for each of the printhead and print bar motors, and to store these parameters in the memory. In response to the controller 50 detecting misalignment that requires movement of a print bar or printhead, controller 50 uses the calibration parameter corresponding to the required direction of movement for the appropriate motor to determine a number of steps that the controller commands the motor to rotate to achieve movement of the print bar or printhead in the required direction.

Figure 4:
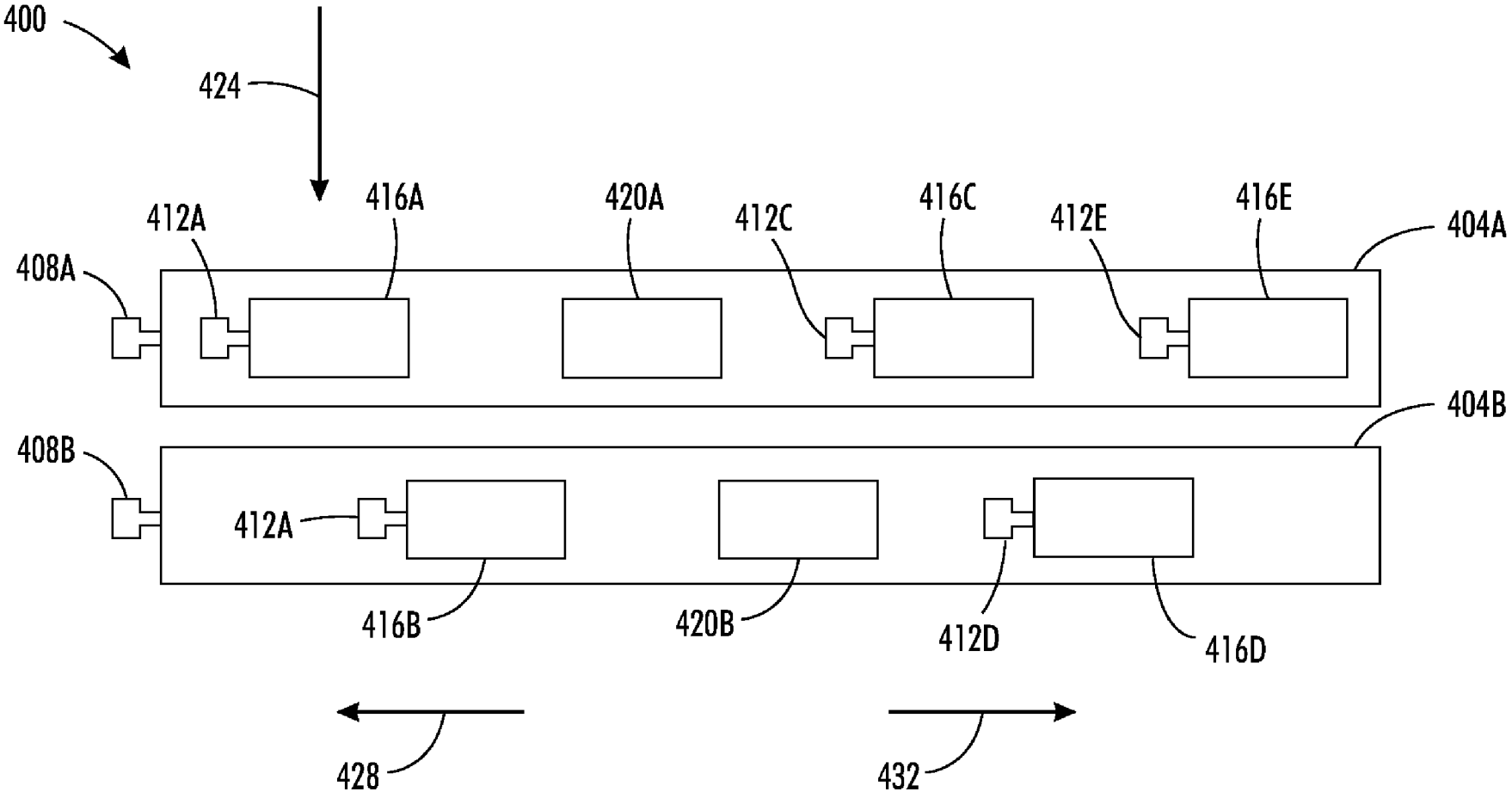
FIG. 4 is a schematic view of a print bar array that may be used to configure an arrangement of printheads in a print zone of the imaging system of FIG. 6.
Figure 7:
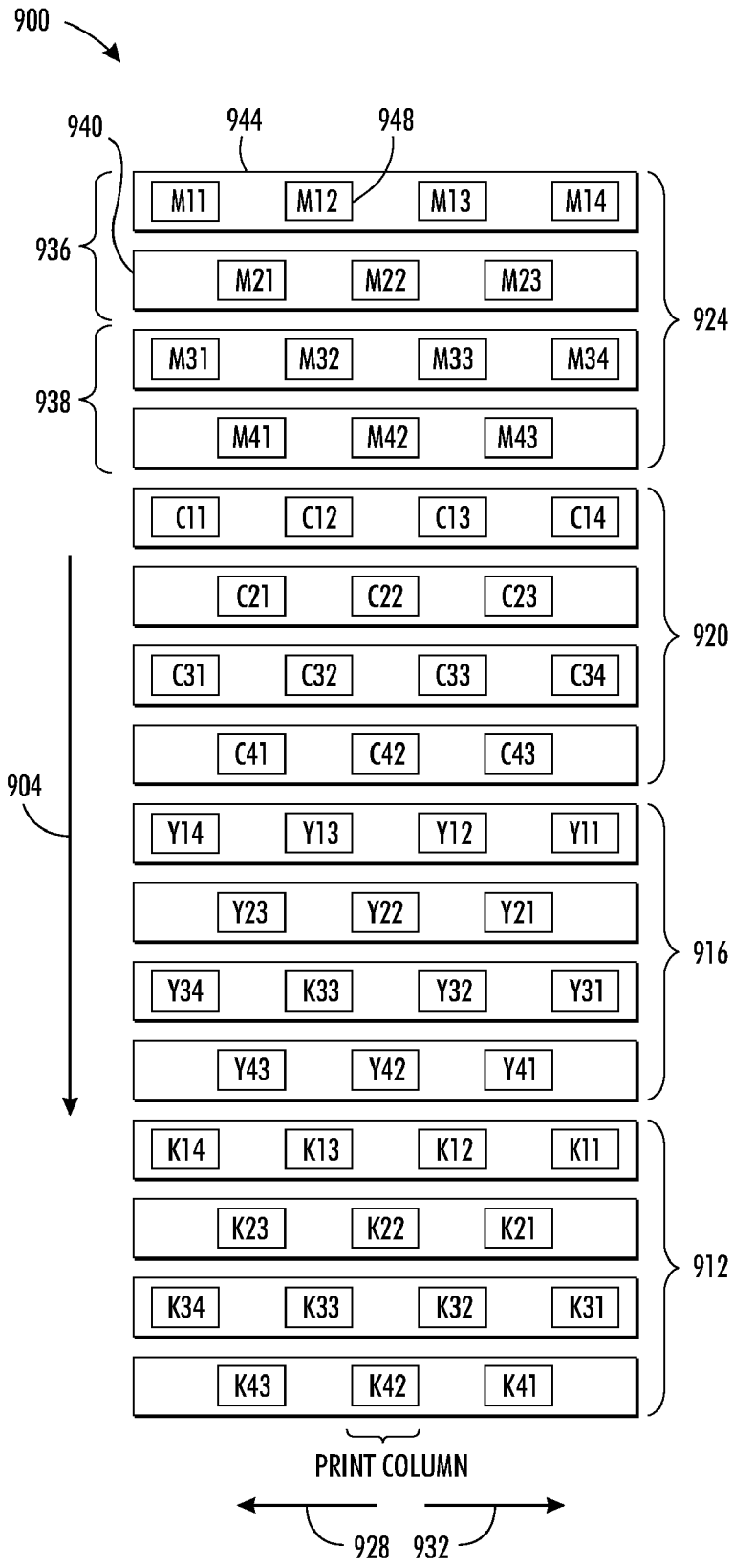
FIG. 7 PRIOR ART
FIG. 7 is a schematic view of a prior art printhead configuration viewed along lines 7-7 in FIG. 6.
Figure 8A:
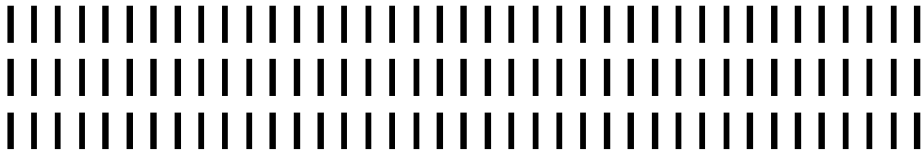
FIG. 8A PRIOR ART
FIG. 8(*a*) is an illustration of image data generated by a linear array of optical detectors with properly aligned lenses.
Figure 8B:
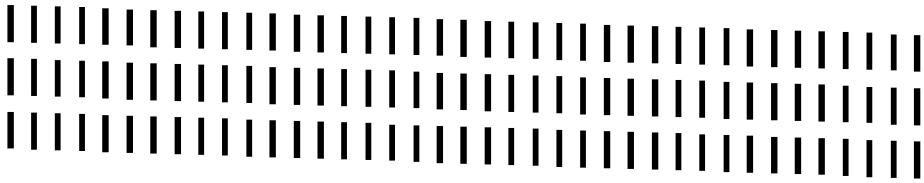
FIG. 8B PRIOR ART
Figure 8C:
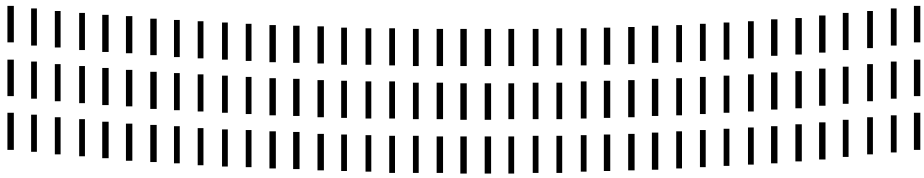
FIG. 8C PRIOR ART
Figure 8D:
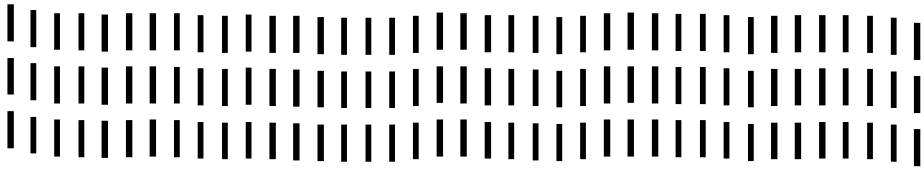
FIG. 8D PRIOR ART

A schematic view of a prior art print zone 900 that may be used in the system 5 is depicted in FIG. 7. The print bars and printheads of this print zone may be moved for alignment purposes using the processes described below when the print bars and printheads are configured with actuators for movement of the print bars and printheads as shown in FIG. 4. The print zone 900 includes four color modules or units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as the member travels under the color units from color unit 924 to color unit 912. Each color unit includes two print arrays, which include two print bars each that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print bar array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

FIG. 4 depicts a configuration for a pair of print bars that may be used in a color module of the system 5. The print bars 404A and 404B are operatively connected to the print bar motors 408A and 408B, respectively, and a plurality of printheads 416A-E and 420A, 420B are mounted to the print bars. Printheads 416A-E are operatively connected to electrical motors 412A-E, respectively, while printheads 420A and 420B are not connected to electrical motors, but are fixedly mounted to the print bars 404A and 404B, respectively. Each print bar motor moves the print bar operatively connected to the motor in either of the cross-process directions 428 or 432. Printheads 416A-416E and 420A-420B are arranged in a staggered array to allow inkjet ejectors in the printheads to print a continuous line in the cross-process direction across a media web. Movement of a print bar causes all of the printheads mounted on the print bar to move an equal distance. Each of printhead motors 412A-412E moves an individual printhead in either of the cross-process directions 428 or 432. Motors 408A-408B and 412A-412D are electromechanical stepper motors capable of rotating a shaft, for example shaft 414, in a series of one or more discrete steps. Each step rotates the shaft a predetermined angular distance and the motors may rotate in either a clockwise or counter-clockwise direction. The rotating shafts turn drive screws that translate print bars 404A-404B and printheads 416A-416E along the cross-process directions 428 and 432. As described herein, the measured sensitivity and backlash of motors 408A-408B and 412A-412E is the degree to which the rotation of the motors causes translation of the print bars and printheads along a cross-process direction across the media. The term "sensitivity" refers to the distance a print bar or printhead moves for each step of a corresponding motor. The term "backlash" refers to the degree to which the translation imparted by a motor in a given direction is reduced due to additional mechanical energy that the motor exerts to reverse its direction of rotation. Thus, backlash occurs in situations where a motor moves in a first direction, and then reverses direction.

While the print bar arrays of FIG. 4 are depicted with a plurality of printheads mounted to each print bar, one or more of the print bars may have a single printhead mounted to the bar. Such a printhead would be long enough in the cross-process direction to enable ink to be ejected onto the media across the full width of the document printing area of the media. In such a print bar array, an actuator may be operatively connected to the print bar or to the printhead. A process similar to the one discussed below may then be used to position such a wide printhead with respect to multiple printheads mounted to a single print bar or to other equally wide printheads mounted to other print bars. The actuators in this embodiment enable the inkjet ejectors of one printhead to be interlaced or aligned with the inkjet ejectors of another printhead in the process direction.

Figure 1:
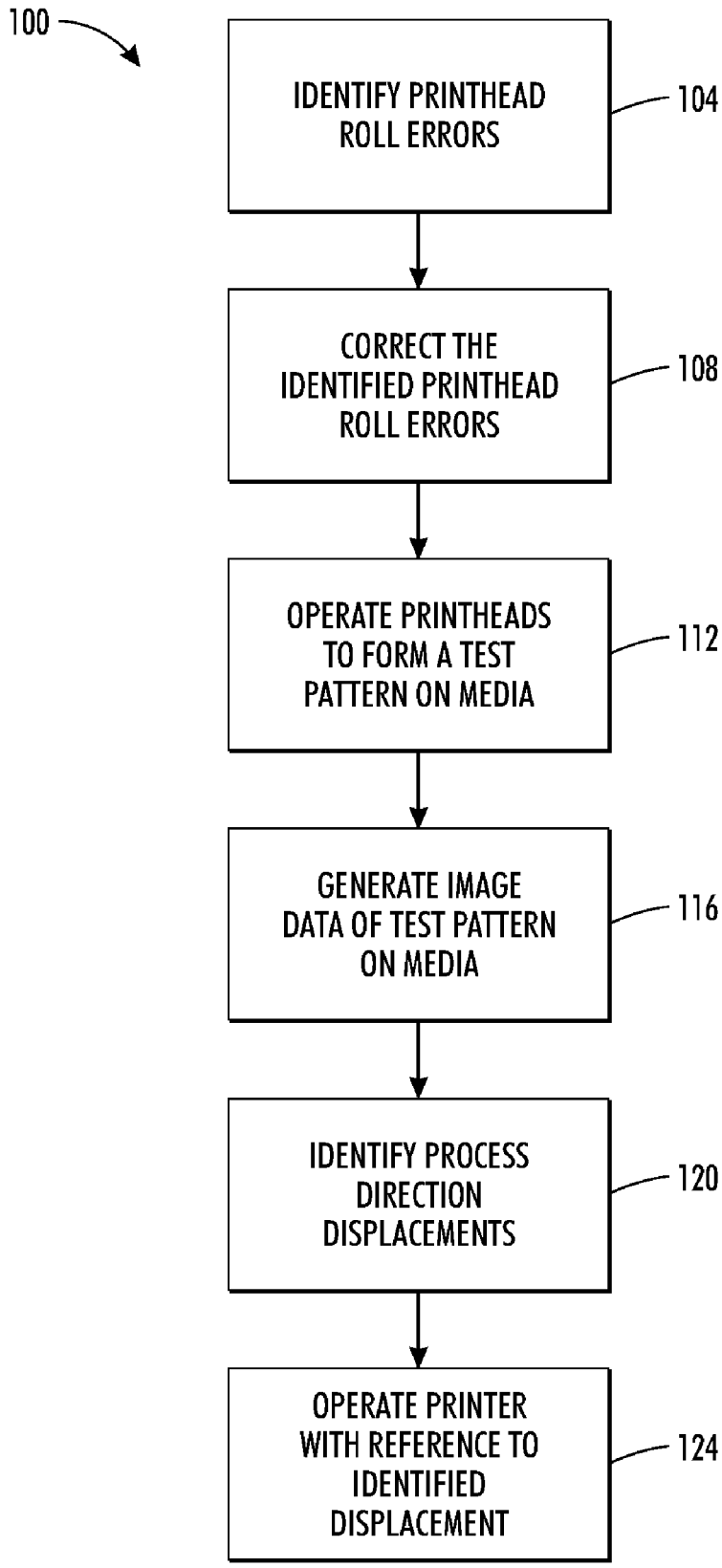
FIG. 1 is a flow diagram of a process for operating a printer to compensate for process direction displacements in an optical imaging system.

Referring to FIG. 1, a block diagram of a process 100 for identifying optical system misalignment is depicted. Process 100 begins by identifying a printhead roll error for each printhead (block 104). A process for detecting printhead roll error is disclosed in co-pending U.S. patent application Ser. No. 12/413,817, which is entitled "Method And System For Detecting Print Head Roll" and which was filed on Mar. 30, 2009. This application is owned by the assignee of this document and is hereby expressly incorporated in its entirety in this document by reference. Process 100 continues by operating actuators operatively connected to the printheads to correct for the identified printhead roll errors (block 108). As used herein, printhead roll error refers to clockwise or counterclockwise rotation of a print head about an axis normal to the image receiving surface.

After the printhead roll errors have been corrected, the printheads are operated to eject ink onto media moving past the printhead in a test pattern (block 112). Image data of the test pattern on the media are sensed by an optical imaging system, such as the one described above, and the image data are analyzed by a controller configured with a program that identifies the process direction positions of each inkjet ejector on the printheads when executed (block 116). Process 100 then identifies a displacement of each optical detector in the optical imaging system from the image data of the test pattern on the media (block 120) Process 100 then passes the displacement of each optical detector to printhead alignment processes, and the detected process direction positions of each inkjet ejector and each printhead are modified by the identified optical detector process direction displacements to give the true displacement of each inkjet detector (block 124). These identified optical detector process direction displacements may be used to modify operation of the printer. Printer operation may include, for example, operating at least one actuator operatively connected to the linear array of optical detectors to compensate for the identified process direction displacement of the optical detectors or modifying image data generated with the optical detectors of the optical imaging system with the identified process direction displacements to compensate for the identified displacements.

An appropriate registration test pattern and method of coarse registration that enables printhead positions to be identified is disclosed in U.S. Utility application Ser. No. 12/754,730 hereby entitled "Test Pattern Effective For Coarse Registration Of Inkjet Printheads And Method Of Analysis Of Image Data Corresponding To The Test Pattern In An Inkjet Printer", which is commonly owned by the owner of this document and was filed on Apr. 6, 2010, the disclosure of which is incorporated into this document by reference in its entirety. Another appropriate registration test pattern and method of fine registration that enables printhead positions to be identified is disclosed in U.S. Utility application Ser. No. 12/754,735 hereby entitled "Test Pattern Effective For Fine Registration Of Inkjet Printheads And Method Of Analysis Of Image Data Corresponding To The Test Pattern In An Inkjet Printer", which is commonly owned by the owner of this document and was filed on Apr. 6, 2010, the disclosure of which is incorporated into this document by reference in its entirety.

Figure 5:
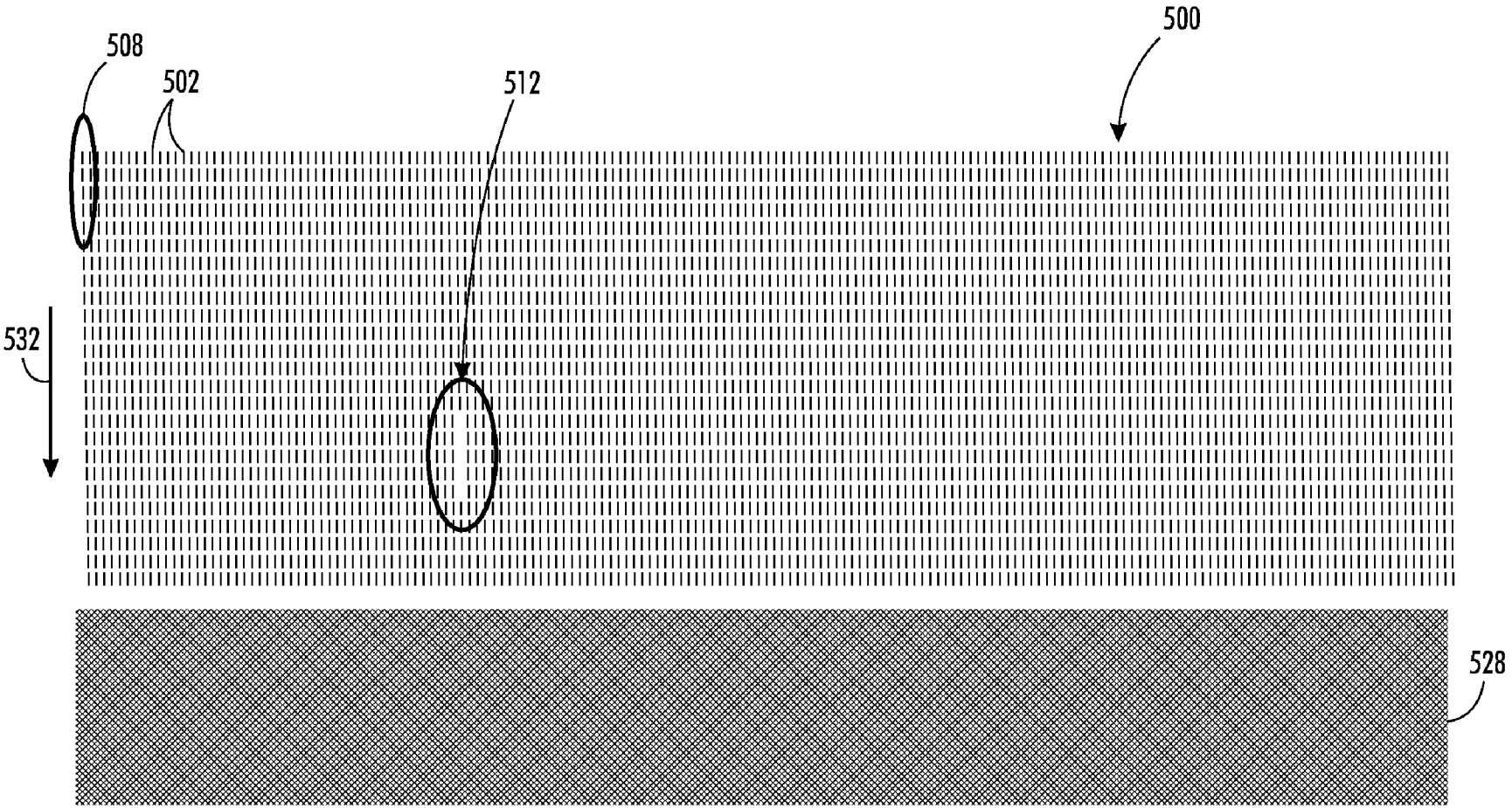
FIG. 5 is an illustration of a portion of a printhead calibration test pattern.

An example of an optical sensor test pattern suitable for use with process 100 is depicted in FIG. 5. The example test pattern 500 includes a series of dashes 502 generated on a media web 528 moving in a process direction 532. The dashes 502 are generated with ejectors in a printhead at a predetermined distance from each other. Each ejector generates a plurality of dashes, for example, five dashes, in the process direction in order to reduce the effects of random errors. Such a group of dashes is identified with reference number 508 in FIG. 5. An inkjet ejector that failed to eject ink to form a group of dashes is shown at reference number 512. Multiple copies of test pattern 500 may be generated along the cross-process direction of media web 528 from each of the printheads in each of the print bar arrays in the printer. Test pattern 500 may also be repeated along the process direction forming columns of repeating dashes. As used in this document, a "dash" refers to a predetermined number of ink drops ejected by an inkjet ejector onto an image receiving substrate. A group of dashes printed by different ejectors form a test pattern. Image data corresponding to this test pattern may then be generated and analyzed to identify positions of the inkjet ejectors and printheads.

Figure 2:
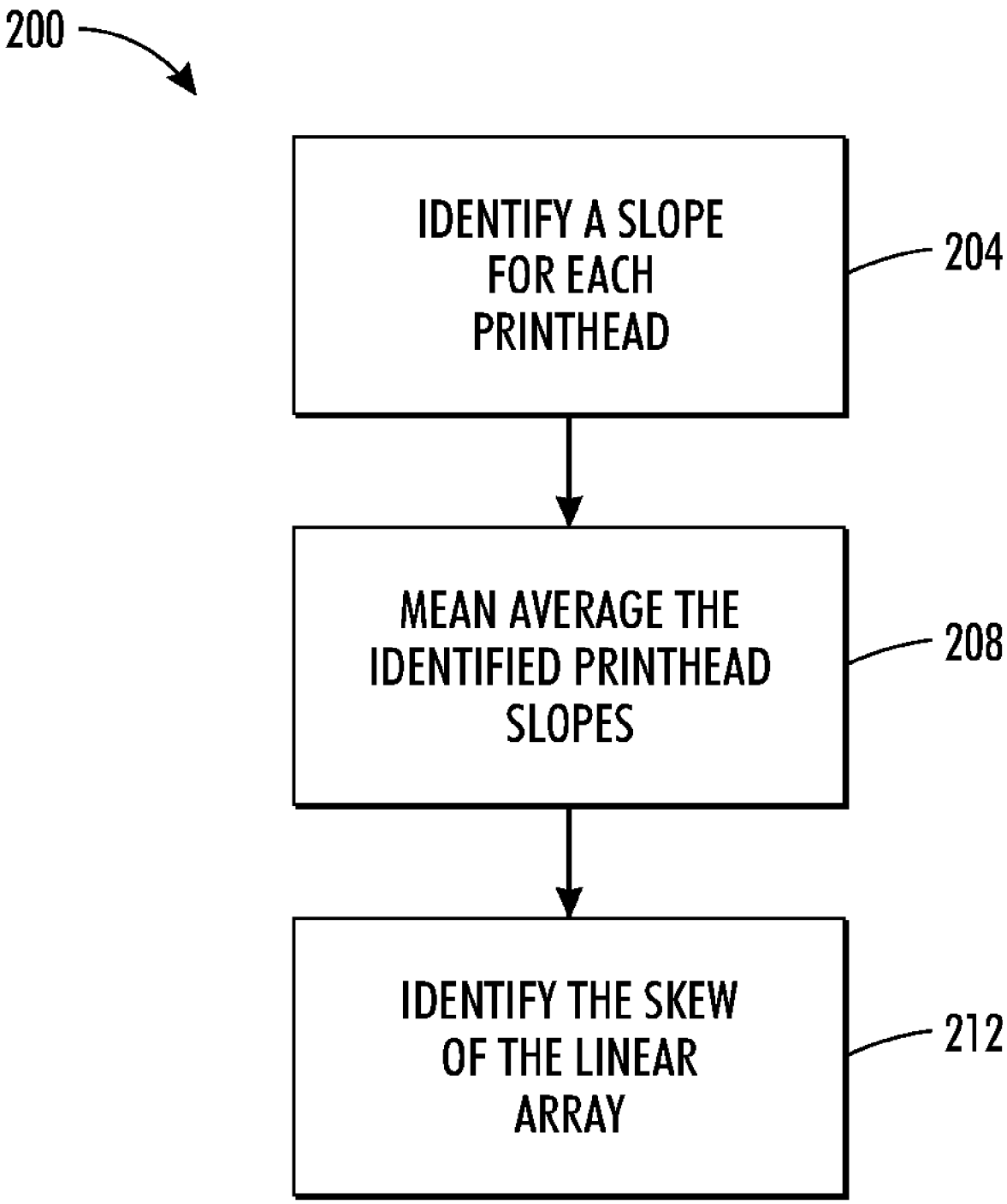
FIG. 2 is a flow diagram of a process for identifying process direction displacements for optical detectors in a linear array of optical detector in the optical imaging system.

The identification of the process direction displacements may be performed by identifying the slope of a curve that plots the process direction displacement of each inkjet ejector as a function of the nozzle index. One source of a non-zero slope could be printhead roll error, but since the printhead roll error has already been corrected in the processing performed at block 108, other causes of the sloping must be at work. Printhead yaw may also be a source of a sloping pattern as well as a skewed linear array of optical detectors. Head yaw is defined as a spacing variation between a printhead and the media receiving ink ejected from the printhead as a function of lateral position across the printhead. Head yaw indicates this gap between the printhead and the media changes across the length of the printhead in the cross-process direction. The changing gap means the distance traveled by ink ejected from the printhead at different lateral positions on the printhead varies. Thus, flight times for the ejected ink drops across the gap vary and a process direction slope is produced. Head yaw, however, is expected to vary randomly from print head to print head. To reduce the contribution of head yaw to the process direction displacement identification, a process 200 (FIG. 2) identifies the slope for each printhead with reference to the identified positions in the process direction of the inkjet ejectors in a printhead over the distance from a first inkjet ejector in the printhead to the last inkjet ejector in the printhead (block 204). The first inkjet ejector is the inkjet ejector that has an aperture that is the leftmost aperture in the array of printhead ejectors for a printhead and the last inkjet ejector is the inkjet ejector that has an aperture that is the rightmost aperture in the array of ejectors. The slopes identified for the printheads in the printer are then mean averaged to obtain an average slope for the printheads (block 208). The skew of the linear array is then identified by multiplying the average slope by the length of the print bar array in the cross-process direction (block 212). This skew may then be used to identify a process direction correction term for each optical detector. The correction term is added to the process direction displacement measured by the optical imaging system to give the true process direction displacement of each inkjet ejector. Although the measured slope of the dash process direction position vs. inkjet ejector nozzle index varies slightly from head to head due to yaw, the average over all the heads more accurately represents the skew of the linear array of optical detectors. As used in this document, "mean average" and "average" refer to any mathematical technique for calculating, identifying, or substantially approximating a statistical average.

Figure 3:
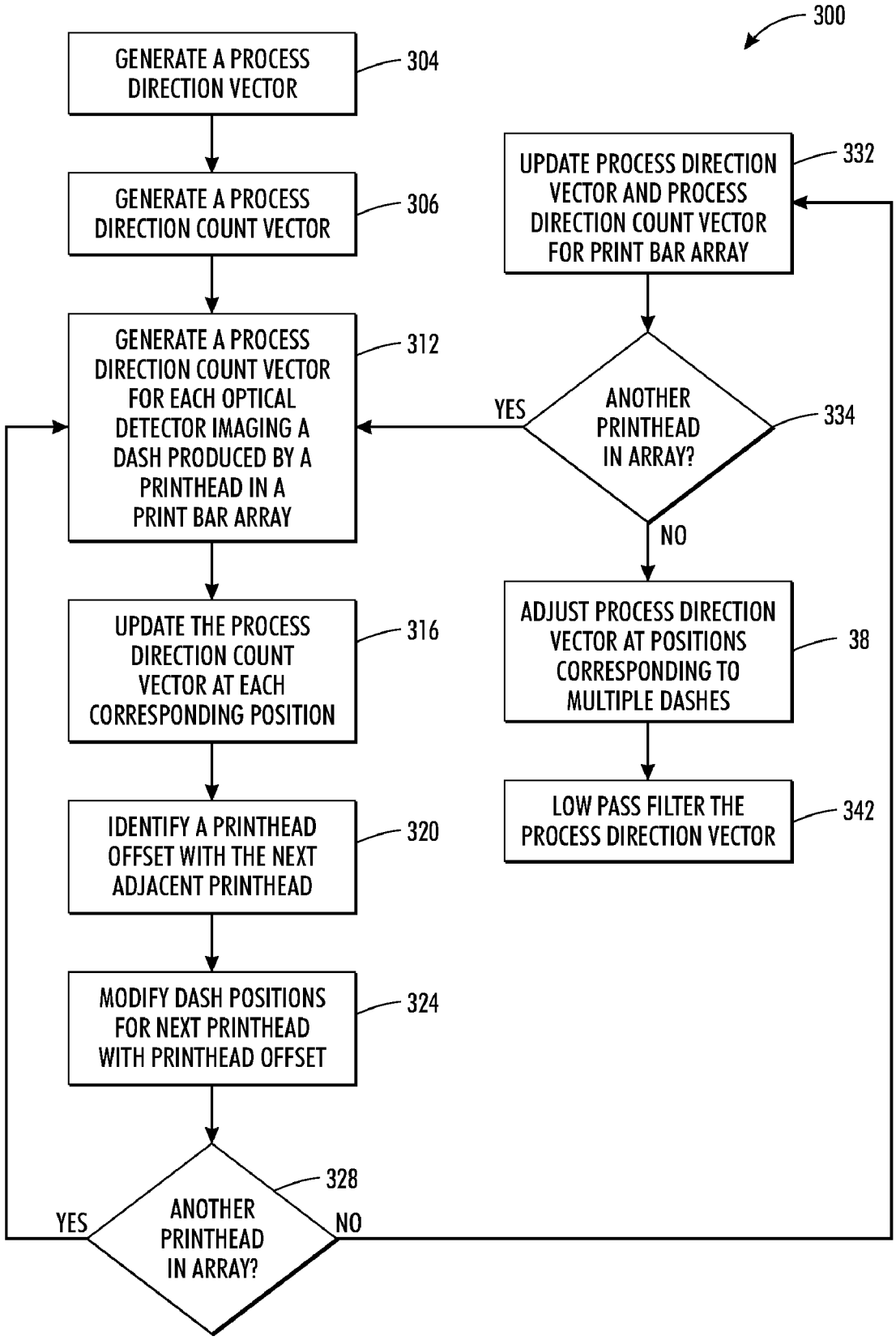
FIG. 3 is a flow diagram of an alternative process for identifying process direction displacements for optical detectors in a linear array of optical detector in the optical imaging system.

Another process for identifying process direction displacements in the linear array of optical detectors is capable of simultaneously identifying skew, bow, and lenslet errors. This process is shown in FIG. 3. This process is performed with a view of analyzing the printheads as print bar arrays that include two print bar arrays having seven printheads as shown in FIG. 4. These printheads are indexed from 1 to 7 with 1 being assigned to the printhead at the leftmost position and the next index number being assigned to the next adjacent printhead in the print bar array until all seven printheads in the print bar array have been assigned an index number. Other indexing schemes may be used. The process 300 begins by generating a process direction vector (block 304) and a process direction count vector (block 308). Both of these vectors have a length equal to the number of optical detectors in the linear array of optical detectors used in the optical imaging system. For each dash generated by an ejector in printhead 1 of a print bar array, the corresponding optical detector that imaged the dash is identified and the value of the vector for that detector is incremented by the process direction position of the dash (block 312). The process direction position of a dash may be the top of a dash, the bottom of a dash, or the center of a dash in the process direction, provided all process direction positions of all of the dashes are identified with reference to the same feature. The process direction positions of the dashes are determined with reference to the positions of neighboring dashes produced by other ejectors. Similarly, the corresponding position in the process direction count vector is also incremented by one (block 316).

A challenge in assigning values to the position vector occurs at the boundary between printheads. The process direction position errors caused by anomalies in the optical imaging system are confounded with any process direction misalignment between the printheads. In the processes described in this document, an assumption is made that the process direction position errors in the optical imaging system are continuous across the boundaries between the printheads. Positions of the dashes produced by the next printhead in the print bar array are identified and a head-to-head offset is identified using these identified positions (block 320). Specifically, the head-to-head offset may be identified with reference to the average process direction positions of the dashes produced by a predetermined number of rightmost ejectors in printhead 1 and the average process direction positions of the dashes produced by the predetermined number of leftmost ejectors in printhead 2. A predetermined number of ejectors are chosen because the process direction of a dash generated by any individual ejector can randomly vary, but averaging the position over a larger number of dashes should produce a smaller position variation. The average process direction position for the rightmost ejectors in printhead 2 is subtracted from the average process direction position for the leftmost ejectors in printhead 1 to identify a process direction printhead offset between the two printheads. This offset is subtracted from the process direction position for each dash produced by the ejectors in printhead 2, and the process direction vector and process direction count vector for printhead 2 are updated (block 312). This process continues until the last printhead positions have been processed (block 328) and the process direction vector and the process direction count vector for the print bar array updated (block 332).

The process continues by updating the process direction vector and the process direction count vector for each print bar array in the printer (blocks 312-334). Some dashes from different print heads are imaged by the same optical detector in the linear array. As a result, the portion of the process direction vector corresponding to that optical detector is equal to the sum of the process direction positions of the dashes that were imaged by this optical detector. Therefore, after the process direction vector has been completed, the process direction vector is adjusted by dividing the accumulated positions by the count in the process direction count vector at the locations corresponding to the optical detector that imaged multiple dashes (block 338). Thus, the process direction vector represents the process direction displacement of a typical dash as a function of position across the linear array of optical detectors. The final process direction vector is then passed through a low pass filter to remove the randomness due to the natural process direction position variations from ejector to ejector (block 342). The resulting process direction vector has a shape dominated by the actual process direction displacements of the linear array of optical detectors.

To compensate for the displacements identified by the process direction vector, a linear array skew may be estimated with a linear fit of the process direction displacements in the process direction vector. This identified skew may then be used to operate actuators, such as electrical motors, operatively connected to the linear array of detectors physically move the linear array and de-skew the linear array. Alternatively, the process direction vector may be used to identify a process direction compensation value for each optical detector. The process direction compensation value may be added to image data generated by a corresponding optical detector to remove the process direction displacements in the image data caused by the skew, bow, or lenslet errors in the linear array. Linear interpolation may be used if the compensation value is not an integer value to enable more uniform corrected image results. The correction of the image may also be performed using video processing during the capture of the image, or two dimensional image processing after the image has been captured. Yet another alternative compensation approach is to analyze the image data of a test pattern to obtain the cross-process and process positions for the dashes that are ultimately used for registration. Before these positions are used for process direction position registration, each individual process direction position is offset by the magnitude of the process direction vector at each optical detector used to image a dash.

In operation, the printheads of a print zone in a printing system are arranged in an appropriate manner to eject ink onto media as the media passes through the print zone and an optical imaging system is positioned to capture image data of the ejected ink on the media after the media has been printed. The linear array of optical detectors in the imaging system is operatively connected to at least one actuator that is operatively connected to one or more controllers configured to operate the actuators. The controller then operates the printheads from time to time to eject ink onto the media in a test pattern. The image data corresponding to the test pattern on the media generated by the imaging system are received by the controller and processed to identify the positions of the printheads. This positional information is processed to identify displacements of the optical detectors in the linear array in the process direction. The controller may then generate commands for operating the at least one actuator to move the linear array to compensate for the detected displacements. Alternatively, the identified displacements may be used as compensation values to adjust image data generated by the imaging system and the adjusted data may then be processed to align printheads. Additional iterations of the process may be performed as determined by the controller processing the image data corresponding to test patterns on media.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for detecting and compensating for displacement of an optical imaging system from an expected position across a path for a media path in a printer comprising:

identifying a printhead roll error for each printhead in a plurality of printheads in a printer;

moving each printhead by an amount that corrects the printhead roll error for the corresponding printhead;

generating a plurality of dashes on media with the plurality of printheads as the media moves past the plurality of printheads;

identifying a position for each dash in the process direction from image data of the plurality of dashes on the media;

identifying a displacement in the process direction for each optical detector in a linear array of optical detectors used to generated the image data of the plurality of dashes, the displacement being identified with reference to the identified positions for the dashes; and operating the printer to compensate for the identified displacements of the optical detectors.

2. The method of claim 1, the printer operation further comprising:

operating at least one actuator operatively connected to the linear array of optical detectors to compensate for the identified displacements of the optical detectors in the process direction.

3. The method of claim 1, the printer operation further comprising:

modifying image data with the identified displacements to compensate for the identified displacements in the process direction.

4. The method of claim 1, the identification of the optical detector displacements in the process direction further comprising:

identifying a position in the process direction of each inkjet ejector in the printhead that ejected ink to form the plurality of dashes, the identified positions for the inkjet ejectors being identified with reference to image data corresponding to the plurality of dashes;

identifying a slope for each printhead, the slope for a printhead corresponding to the identified positions in the process direction of the inkjet ejectors in the printhead over a distance from a first inkjet ejector in a printhead to a last inkjet ejector in the printhead; and averaging the slopes for the printheads to obtain a reference for identifying the displacements of the optical detectors.

5. The method of claim 1, the identification of the optical detector displacements further comprising:

generating a process direction vector that identifies a displacement distance for image data generated by each optical detector in the linear array of optical detectors.

6. The method of claim 5, the generation of the process direction vector further comprising:

adjusting the process direction vector at each portion of the process direction vector that corresponds to an optical detector that generated image data for multiple dashes.

7. The method of claim 6 wherein the adjustment of the process direction vector at each portion of the process direction vector that corresponds to an optical detector that generated image data for multiple dashes is made with reference to a number of dashes imaged by the optical detector corresponding to the portion being adjusted.

8. The method of claim 6 further comprising:

low pass filtering the process direction vector; and operating the printer with reference to the process direction vector after the process direction vector has been low pass filtered.

9. The method of claim 5, the process direction vector generation further comprising:

identifying a process direction offset between a boundary between a first printhead and a next printhead in a cross-process direction in a first print bar array of a plurality of print bar arrays in the printer;

subtracting the process direction offset to each pixel in the image data that corresponds to ink ejected by the next printhead in the first print bar array;

continuing to identify a process direction offset between successive printheads in the first print bar array in the cross-process direction and subtracting the process direction offset to each pixel in the image data that corresponds to ink ejected by the next successive printhead; and identifying the process direction positions for each pixel corresponding to ink drops ejected by all of the printheads in each remaining print bar array in the plurality of print bar arrays by identifying a process direction offset between adjacent printheads in each print bar array and subtracting the process direction offset to next successive printhead in the cross-process direction.

10. A printer comprising:

a media transport that is configured to transport media through the printer in a process direction;

a plurality of print bars, each print bar having a plurality of printheads mounted to each print bar and each printhead being configured to eject ink onto media being transported past the plurality of print bars by the media transport;

an imaging device mounted proximate to a portion of the media transport to generate image data corresponding to a cross-process portion of the media being transported through the printer in the process direction after the media has received ink ejected from the printheads; and a controller operatively connected to the imaging device and the plurality of printheads, the controller being configured to operate the printheads to eject ink onto media to form a first plurality of dashes as the media is being transported past the printheads on the bars, to receive image data of the first plurality of dashes on the media generated by the imaging device, to process the image data to identify a displacement distance for each optical detector in the imaging system with reference to an identified position for each dash in the image data of the first plurality of dashes, and to compensate for the identified process direction displacements in operation of the printer.

11. The printer of claim 10, the imaging system further comprising:

a linear array of optical detectors arranged in a cross-process direction across the media passing through the printer;

an actuator operatively connected to the linear array and to the controller; and the controller being further configured to operate the actuator operatively connected to the linear array of optical detectors to compensate for the identified displacements of the optical detectors.

12. The printer of claim 10, the controller being further configured to modify image data with the identified displacement distances to compensate for the identified displacement distances.

13. The printer of claim 10, the controller being further configured to identify a position in the process direction of each inkjet ejector in the printhead that ejected ink to form the plurality of dashes, the identified positions for the inkjet ejectors being identified with reference to image data corresponding to the plurality of dashes, and to identify a slope for each printhead, the slope for a printhead corresponding to the identified positions in the process direction of the inkjet ejectors in the printhead over a distance from a first inkjet ejector in a printhead to a last inkjet ejector in the printhead, and to average the slopes for the printheads to obtain a reference for identifying the displacements of the optical detectors.

14. The printer of claim 10, the controller being further configured to generate a process direction vector that identifies a displacement distance for image data generated by each optical detector in the linear array of optical detectors.

15. The printer of claim 14, the controller being further configured to adjust the process direction vector at each portion of the process direction vector that corresponds to an optical detector that generated image data for multiple dashes.

16. The printer of claim 15 wherein the controller is configured to adjust the process direction vector at each portion with reference to a number of dashes imaged by the optical detector corresponding to the portion being adjusted.

17. The printer of claim 16 further comprising:

a low pass filter operatively connected to the controller, the low pass filter being used to modify the process direction vector.

18. The printer of claim 14, the controller being further configured to adjust image data corresponding to ink ejected by printheads in each print bar array with a process direction offset identified between adjacent printheads in the print bar array.

* * * * *